United States Patent [19]

Sato et al.

[11] 3,972,822

[45] Aug. 3, 1976

[54] WATER-INSENSITIVE AND STABLE HYDRAULIC FLUID COMPOSITIONS

[75] Inventors: Teruyuki Sato, Kyoto; Motohiko Ii, Uji, both of Japan

[73] Assignee: Sanyo Chemical Industries, Ltd., Kyoto, Japan

[22] Filed: Dec. 3, 1974

[21] Appl. No.: 529,079

[30] Foreign Application Priority Data

Dec. 3, 1973 Japan ..... 48-138482

[52] U.S. Cl. ..... 252/78.1

[51] Int. Cl.[2] ..... C10M 3/48; C09K 3/00

[58] Field of Search ..... 252/78

[56] References Cited

UNITED STATES PATENTS 3,711,410 1/1973 Sawyer et al. ..... 252/78

FOREIGN PATENTS OR APPLICATIONS 2,257,546 6/1973 Germany

*Primary Examiner*—Harris A. Pitlick

*Attorney, Agent, or Firm*—Oblon, Fisher, Spivak, McClelland & Maier

[57] ABSTRACT

DOT 4 grade of hydraulic fluid compositions having a stability to hydrolysis is formed from 40 to 65% by weight of a polyglycol monoether, 16 to 45% by weight of a polyglycol and 10 to 19% by weight of a borate ester.

8 Claims, No Drawings

WATER-INSENSITIVE AND STABLE HYDRAULIC FLUID COMPOSITIONS

BACKGROUND OF THE INVENTION

1. Field of the Invention

This invention relates to hydraulic fluid compositions for use in hydraulic systems of automobiles, etc. More particularly, it relates to water-insensitive and stable brake fluid compositions which can maintain high boiling points even when water is added to the initial fluid compositions.

2. Description of the Prior Art

A great number of hydraulic fluid compositions have been suggested in the art. Commonly, the hydraulic fluids are made up of three principal units. The first is a base or lubricant for the system which may include heavy bodied fluids such as polyglycols. Diluents such as glycol ethers and alcohols, which are employed for the purpose of controlling the viscosity of the fluid, form the second basic unit. Finally, the third unit is represented by an inhibitor system comprising small quantities of inhibitors which are added, for example, to reduce oxidation and to minimize corrosion. Although the hydraulic fluids of the prior art possesses one or more of these desired characteristics. they all suffer from one or more disadvantages. Fluids known in the art are hygroscopic and water-sensitive. Such properties are undesirable under many practical conditions of use. In particular, absorbed water tends to increase the vapor pressure of the fluid composition and to lower its boiling point, both of which are serious disadvantages when the fluid composition is to be used under conditions of high temperature, because they contribute to causing vapor lock.

Some attempts have been made to develop an improved hydraulic fluid which does not cause vapor lock (in other words, not sensitive to moisture, or not subject to decreases in boiling point). British Pat. No. 1,214,171, discloses an improved hydraulic fluid which comprises a borate ester from 54.5to 92% by weight, and a polyoxyalkylene glycol mono or diether from 3 to 43% by weight, based on the total weight of the fluid composition. Such an hydraulic fluid has demonstrated quite small decreases in boiling point due to water absorption (wet equilibrium reflux boiling point) such that it is capable of meeting the requirements for grade DOT 4 with respect to the wet equilibrium reflux boiling point, when the hydraulic fluid is tested according to the hydraulic fluid specifications of the U.S. Department of Transportation [DOT]. The hydraulic fluid in the above British Patent liberates a precipitate under test conditions, wherein the fluid is allowed to stand at room temperature following heating at 100°C for 120 hours. The precipitation may be caused by hydrolysis of the borate ester (one of the basic components of the fluid) with the absorbed water under the test conditions (e.g. high temperature) to form boric acid which is easy to precipitate. The precipitation must be avoided because it results in the formation of deposits in brake devices, with consequent lowering of brake efficiency.

A need exists therefore, for a hydraulic fluid which is capable of fully meeting the standards of DOT 4 in both the wet equilibrium reflux boiling point test, and in the evaporation test.

SUMMARY OF THE INVENTION

Accordingly, one object of this invention is to provide hydraulic fluids which can meet the requirements for DOT 4 grade.

Another object of this invention is to provide hydraulic fluids which have boiling points, low sensitivity to water and high stability to hydrolysis.

Yet another object of this invention is to provide brake fluid compositions which can be applicable under severe conditions without causing vapor lock or precipitation or a boric compound.

Briefly, these objects and other objects of the invention as hereinafter will become more readily apparent can be attained broadly by providing a hydraulic fluid composition (A) 40 to 65% by weight, based on the total weight of the fluid composition, of a polyglycol monoether having the formula (1):

$$R_1 \text{-}\!\left(OA_1\right)_x\!\text{-}OH \qquad (1)$$

(wherein $R_1$ is alkyl having 1 to 4 carbon atoms, $A_1$ is alkylene having 2 to 4 carbon atoms, and $x$ is 3 to 5), (B) 16 to 45% by weight, based on the total weight of the fluid composition, of a polyglycol having the formula (2):

$$H\text{-}\!\left(OA_2\right)_y\!\text{-}OH \qquad (2)$$

(wherein $A_2$ is alkylene having 2 to 4 carbon atoms, and $y$ is 2 to 7); and (C) 10 to 19% by weight, based on the total weight of the fluid composition, of a borate ester of the formula (3):

$$[R_2\text{-}\!\left(OA_3\right)_z\!\text{-}O]_3\,B \qquad (3)$$

(wherein $R_2$ is alkyl having 1 to 4 carbon atoms, $A_3$ is alkylene having 2 to 4 carbon atoms, $z$ is 3 to 5 and B is the boron atom); wherein the sum of (A) and (B) is more than 80% by weight based on the total weight of the fluid composition.

DESCRIPTION OF THE PREFERRED EMBODIMENTS

Polyglycol monoethers having the formula (1) [Component (A)] include, for example, triethylene glycol monomethyl ether, tetraethylene glycol monomethyl ether, pentaethylene glycol monomethyl ether, triethylene glycol monobutyl ether, trialkylene glycol monobutyl ether (obtained by adding a mixture of ethylene oxide and propylene oxide in a weight ratio of 1:1 to butyl alcohol), ditetramethylene glycol monobutyl ether, tributylene glycol monoethyl ether and mixtures thereof. Other examples are those mentioned in British Pat. No. 1,214,171. The preferred glycol monoethers are triethylene glycol monomethyl ether, tetraethylene glycol monomethyl ether, and triethylene glycol monobutyl ether.

Polyglycol having the formula (2) [Component (B)], for example, diethylene glycol, triethylene glycol, polyoxyethylene glycol (molecular weight in the range of 200–300), tripropylene glycol, polyoxypropylene glycol (molecular weight in the range of 200–300), a random addition product of ethylene oxide and propylene oxide with glycol (molecular weight in the range 200–300) tritetramethylene glycol and mixtures thereof. The preferred polyglycols are polyethylene glycols (molecular weight of 150–300).

Borate esters having the formula (3) [Component (C)] include, for example, triborate esters of polyglycol monoether. Examples of the polyglycol monoether are those which are mentioned above in the explanation of the glycol monoether having the formula (1). Mixtures of two or more polyglycol monoethers may be used. Practical examples of the triborate ester are those mentioned in British Pat. No. 1,214,171. The preferred examples are triborate ester of triethylene glycol monomethyl ether, triborate ester of tetraethylene glycol monomethyl ether and triborate ester of triethylene glycol monobuthyl ether.

The polyglycol monoethers for the Component (A) and for the borate ester [Component (C)] may be chosen independently, and need not be the same in the hydranlic fluid of this invention.

The borate ester may be prepared by conventional methods. Thus, the borate may be obtained by reacting orthoboric acid and the polyglycol monoether in the presence of an azeotropic solvent mixture. A mixture of Components (A) and (C) may be prepared in a single step by using a large excess of the polyglycol monoether in the above reaction system.

In this invention, the ratio by weight percent of Components (A) (B) and (C) must be 40–65 : 16–45 : 10–19 (preferably 45–60 : 20–35 : 15–19), wherein the sum total of weight percent of Components (A) and (B) must be more than 80. If the brake fluid contains less than 40% by weight of Component (A) based on the total weight of the fluid, the borate ester of the fluid will be easily hydrolyzed, and kinematic viscosity thereof at low temperature (−40°C.) shall be greater than the value for the DOT 4 brake fluid, while more than 65% by weight of Component (A) shall increase the loss by evaporation in the DOT 4 test. Component (B) must be present in the amount of more than 16% by weight, considering the loss by evaporation, the stability to hydrolysis of the borate ester, viscosity and insensitivity to water. The sum total of Components (A) and (B) must be more than 80% by weight, because of the balance between the above total amount and amount of Component (C) which is essential to prevent the formation and precipitation of an insoluble compound such as boric acid. As to Component (C) the presence in the amount of less than 10% by weight does not impart the water-insensitivity to the hydraulic fluid, while more than 19% by weight of Component (C) has an adverse affect to the stability against the hydrolysis at an elevated temperature.

Additional Components (D) may be incorporated into the hydraulic fluid of the present invention. Their examples are an antioxidant (e.g., phenyl-alphanaphthylamine, di-n-butylamine, 2,4-dimethyl -6-tert-butylphenol or 4,4-butylidene bis (6-tert-butyl-m-cresol); a corrosion inhibitor such as alkanolamines (including mono,di and triethanol amines), morpholine, cyclohexylamine, benzotriazole or melcaptobenzotriazole; pH controlling agent; and antifoaming agent. A total amount of these components are 0 to 10% (preferably 0.1 – 5%) by weight based on the total weight of the fluid.

The hydraulic fluid compositions of this invention satisfy completely the requirement for a good brake fluid in the tests of viscosity, stability at high temperature, rubber swelling property and corrosion. Moreover, they have the water-insensitivity, the small decrease of boiling point (wet reflux boiling point) and the good resistance to hydrolysis, so that they pass the DOT 4 hydraulic fluid test.

The above advantages (particularly, the stability to hydrolysis) of this invention are considered to result from the following reasons; the hydrolysis of borate ester may take place according to the following equation:

$$[R_2 \text{-} (OA_3)_z O]_3 B + 3H_2O \rightleftarrows 3R_2 \text{-} (OA_3)_z OH + H_3BO_3$$

wherein $R_2$, $A_3$, B and z are the same as defined in the formula (3), and so the hydrolysis may be prevented by controlling the amount of hydroxyl compounds [i.e., Component (A) and (B)] so as to shift the equiliblium to the left according to this invention. Furthermore, Component (B) has a considerably high boiling point, and so it remains in the hydraulic fluid without loss even after the heating according to DOT 4 evaporation test, resulting in the prevention of hydrolysis reaction.

The following examples which illustrate various embodiments of this invention are to be considered not limitative.

EXAMPLE 1

A hydraulic fluid of this invention having the following composition was prepared.

| | % by weight |
|---|---|
| $[CH_3\text{-}(OCH_2CH_2)_3O]_3B$ | 18.0 |
| $CH_3\text{-}(OCH_2CH_2)_3OH$ | 48.0 |
| $H\text{-}(OCH_2CH_2)_3OH$ | 33.5 |
| Diethanolamine | 0.5 |

EXAMPLE 2

A hydraulic fluid of this invention having the following composition was prepared.

| | % by weight |
|---|---|
| $[CH_3\text{-}(OCH_2CH_2)_3O]_3B$ | 18.0 |
| $C_4H_9\text{-}(OCH_2CH_2)_3OH$ | 19.4 |
| $CH_3\text{-}(OCH_2CH_2)_3OH$ | 30.0 |
| $H\text{-}(OCH_2CH_2)_3OH$ | 32.0 |
| Diethanol amine | 0.5 |
| 2.4-dimethyl-6-tert-butyl phenol | 0.1 |

EXAMPLE 3

A hydraulic fluid of this invention having the following composition was prepared.

| | % by weight |
|---|---|
| $[CH_3\text{-}(OCH_2CH_2)_3O]_3B$ | 18.0 |
| $CH_3\text{-}(OCH_2CH_2)_3OH$ | 50.0 |
| $H\text{-}(OCH_2CH_2)_n OH$ (mol. wt. 200) | 31.2 |
| morpholine | 0.8 |

EXAMPLE 4

A hydraulic fluid of this invention having the following composition was prepared.

| | % by weight |
|---|---|
| $[CH_3\text{-}(OCH_2CH_2)_3O]_3B$ | 18.0 |
| $CH_3\text{-}(OCH_2CH_2)_3OH$ | 47.5 |
| $H\text{-}(OCH_2CH_2)_3OH$ | 34.0 |

-continued

| | |
|---|---|
| Diethanolamine | 0.5 |

EXAMPLE 5

A hydraulic fluid of this invention having the following composition was prepared.

| | % by weight |
|---|---|
| $[CH_3-(OCH_2CH_2)_{13}O]_3B$ | 18.0 |
| $CH_3-(OCH_2CH_2)_{13}OH$ | 60.0 |
| $H-(OCH_2CH_2)_{13}OH$ | 21.0 |
| Diethanol amine | 1.0 |

EXAMPLE 6

A hydraulic fluid of this invention having the following composition was prepared.

| | % by weight |
|---|---|
| $[CH_3-(OCH_2CH_2)_4O]_3B$ | 13.0 |
| $CH_3-(OCH_2CH_2)_{13}OH$ | 55.0 |
| $H-(OCH_2CH_2)_7OH$ (Mol. wt. 200) | 31.2 |
| Triethanol amine | 0.8 |

COMPARATIVE EXAMPLE 1

A hydraulic fluid described in the British Pat. Specification No. 1,214,171 having the following composition was prepared.

| | % by weight |
|---|---|
| $[CH_3-(OCH_2CH_2)_7O]_3B$ | 67.39 |
| $CH_3-(OCH_2CH_2)_{13}OH$ | 23.20 |
| $H-(OCH_2CH_2)_7OH$ (Mol. wt. 300) | 7.62 |
| Diethanol amine | 1.78 |

-continued

| | |
|---|---|
| $NaNO_2$ | 0.01 |

COMPARATIVE EXAMPLE 2

A conventional hydraulic fluid having the following composition was prepared.

| | % by weight |
|---|---|
| polyalkylene glycol monobutyl ether* (Viscosity 130 cp at 20°C) | 25.0 |
| $CH_3-(OCH_2CH_2)_{13}OH$ | 59.4 |
| $H-(OCH_2CH_2)_{13}OH$ | 15.4 |
| Triethanol amine | 0.6 |

*An addition product of ethylene oxide and propylene oxide in a weight ratio of 1:1 to n-butyl alcohol.

The fluid compositions of Examples 1–6 and Comparative examples 1–2 were tested according to the procedure of DOT 4 Specification. Pertinent data relating these tests are shown in Table 1 and 2. All of the fluids of this invention tested (i.e. the fluids of Example 1–6) were found to satisfy completely the requirements for DOT 4 type hydraulic fluids, especially on evaporation (precipitate) test, the hydraulic fluids of this invention after the evaporation test contained no precipitate.

Some of the physical properties were determined by the following procedures:

1. Reflux boiling point (wet)

The (equilibrium) reflux boiling point was measured after 100 ml. of a sample (brake fluid) was maintained in the atmosphere of 80% relative humidity for such time that 100 ml. of standard fluid (RM-1) specified by SAE (the Society of Automotive Engineers) absobed 3% by weight of water in the same condition.

2. Evaporation 100g ml. of a sample was maintained at 100°±2°C for 120 hours, and the loss by evaporation was measured, and, furthermore, the residue after evaporation was allowed to stand at room temperature to observe whether precipitate would appear or not.

Table 1

| Test | DOT 12 . 4 Specification | Example 1 | Example 2 | Example 3 | Example 4 |
|---|---|---|---|---|---|
| Reflux boiling point (dry)°C. | 230< | 262 | 258 | 254 | 264 |
| Reflux boiling point (wet)°C. | 155< | 163 | 162 | 160 | 163 |
| Viscosity, | | | | | |
| −40°C., cs | 1800> | 1402 | 1295 | 1323 | 1524 |
| 100°C., cs | 1.5< | 2.31 | 2.16 | 2.21 | 2.24 |
| Evaporation (120hrs. at 100°C.) loss % | 80> | 54 | 60 | 63 | 51 |
| precipitate | none | No ppt. (>2 weeks) | No ppt. (>2 weeks) | No ppt. (>2 weeks) | No ppt. (>2 weeks) |
| pH value | 7–11 | 7.4 | 7.3 | 8.1 | 7.6 |

| Test | Example 5 | Example 6 | Comperative Example 1 | Comperative Example 2 |
|---|---|---|---|---|
| Reflux boiling point (dry)°C. | 262 | 259 | 258 | 238 |
| Reflux boiling point (wet)°C. | 159 | 161 | 173 | 142 |
| Viscosity, | | | | |
| −40°C., cs | 839 | 1206 | 1743 | 1452 |
| 100°C., cs | 1.98 | 2.12 | 2.71 | 2.36 |
| Evaporation (120hrs. at 100°C.) loss % | 73 | 67 | 62 | 65 |
| precipitate | No ppt. (>2 weeks) | No ppt. (>2 weeks) | Ppt. (>3 days) | No ppt. (>2 weeks) |

Table 1-continued

| pH value | 9.4 | 8.3 | 7.9 | 8.1 |
|---|---|---|---|---|

Note:
No ppt. (>2 weeks) means no precipitate for more than 2 weeks.
Ppt. (>3 days) means precipitate after 3 days.

What is claimed is:

1. A hydraulic fluid composition which comprises (A) 40 to 65% by weight, based on the total weight of the fluid composition, of a polyglycol monoether having the formula:

$$R_1 \text{-}(OA_1)_x\text{-}OH \qquad (1)$$

(wherein $R_1$ is alkyl having 1 to 4 carbon atoms, $A_1$ is alkylene having 2 to 4 carbon atoms, and $x$ is 3 to 5); (B) 16 to 45% by weight, based on the total weight of the fluid composition, of a polyglycol having the formula:

$$H\text{-}(OA_2)_y\text{-}OH \qquad (2)$$

(wherein $A_2$ is alkylene having 2 to 4 carbon atoms, and $y$ is 2 to 7); and (C) 10 to 19% by weight, based on the total weight of the fluid composition, of a borate ester of the formula:

$$[R_2\text{-}(OA_3)_z\text{-}O]_3\text{-}B \qquad (3)$$

(wherein $R_2$ is alkyl having 1 to 4 carbon atoms, $A_3$ is alkylene having 2 to 4 carbon atoms, $z$ is 3 to 5, and B is the boron atom); wherein the sum of (A) and (B) is more than 80% by weight based on the total weight of the fluid composition.

2. The hydraulic fluid composition of claim 1, wherein 0–10% by weight, based on the total weight of the fluid composition, of an additional component (D) is incorporated into the fluid composition, selected from the group consisting of antioxidant corrosion inhibitor, pH controlling agent and antifoaming agent.

3. The hydraulic fluid composition of claim 2, wherein the additional component is at least one member selected from the group consisting of corrosion inhibitors and antioxidants.

4. The hydraulic fluid composition of claim 1, wherein the components (A), (B) and (C) are present in a weight percent ratio of 40–60; 20–35; 15–19.

5. The hydraulic fluid composition of claim 1, wherein the polyglycol monoether is at least one member selected from the group consisting of triethylene glycol monomethyl ether, tetraethylene glycol monomethyl ether, and triethylene glycol monobutyl ether.

6. The hydraulic fluid composition of claim 1, wherein the polyglycol is at least one member selected from the group consisting of polyethylene glycols (molecular weight of 150–300).

7. The hydraulic fluid compositon of claim 1, wherein the triborate esters of polyglycol monoether is at least one member selected from the group consisting of triborate ester of triethylene glycol monomethylether, triborate ester of tetraethylene glycol monomethyl ether and triborate ester of triethylene glycol monobutyl ether.

8. The hydraulic fluid composition of claim 2, wherein the additional component (D) is present in an amount of 0.1–5% weight.

* * * * *

UNITED STATES PATENT AND TRADEMARK OFFICE

CERTIFICATE OF CORRECTION

PATENT NO. : 3,972,822

DATED : August 3, 1976

INVENTOR(S) : TERUYUKI SATO ET AL

It is certified that error appears in the above-identified patent and that said Letters Patent are hereby corrected as shown below:

In column 2, line 7, "boiling points" should read --high boiling points--.

In column 6, line 36, "absobed" should read --absorbed--.

In Table 1, "DOT 12.4" should read --DOT 4--; also in Table 1, "specification" should read --specifications--.

In column 7, line 14, "$R_1 \{ OA_1 \}_J OH$" should read --$R_1 \{ OA_1 \}_X OH$--.

Signed and Sealed this

Fourth Day of January 1977

[SEAL]

*Attest:*

RUTH C. MASON
*Attesting Officer*

C. MARSHALL DANN
*Commissioner of Patents and Trademarks*